US008887609B1

(12) United States Patent
Cherry

(10) Patent No.: US 8,887,609 B1
(45) Date of Patent: Nov. 18, 2014

(54) EXPLOSIVE SYSTEM FOR DESTRUCTION OF OVERPACKED MUNITIONS

(76) Inventor: Christopher R. Cherry, Albuquerque, NM (US)

( * ) Notice: Subject to any disclaimer, the term of this patent is extended or adjusted under 35 U.S.C. 154(b) by 152 days.

(21) Appl. No.: 12/714,340

(22) Filed: Feb. 26, 2010

Related U.S. Application Data

(60) Provisional application No. 61/156,289, filed on Feb. 27, 2009.

(51) Int. Cl.
*F42B 33/00* (2006.01)

(52) U.S. Cl.
USPC ..... 86/50

(58) Field of Classification Search
USPC ..... 102/306, 307, 403; 89/1.15, 1.13; 86/50
See application file for complete search history.

(56) References Cited

U.S. PATENT DOCUMENTS

| | | | | | |
|---|---|---|---|---|---|
| 2,605,704 | A | | 8/1952 | Dumas | |
| 3,076,408 | A | | 2/1963 | Poulter et al. | |
| 3,185,089 | A | * | 5/1965 | Parkhurst et al. | 102/307 |
| 3,855,929 | A | * | 12/1974 | Ridgeway | 102/331 |
| 4,408,535 | A | | 10/1983 | Alford | |
| 4,499,828 | A | | 2/1985 | Honodel | |
| 4,628,819 | A | | 12/1986 | Backofen et al. | |
| 4,693,181 | A | * | 9/1987 | Dadley et al. | 102/307 |
| 4,957,027 | A | * | 9/1990 | Cherry | 89/1.14 |
| 5,033,387 | A | * | 7/1991 | Lips | 102/475 |
| 5,524,546 | A | | 6/1996 | Rozner et al. | |
| 5,814,758 | A | | 9/1998 | Leidel | |
| 6,220,166 | B1 | | 4/2001 | Cherry | |
| 6,269,725 | B1 | | 8/2001 | Cherry | |
| 6,817,297 | B1 | | 11/2004 | Greene et al. | |
| 7,086,629 | B2 | | 8/2006 | Hilden et al. | |
| 7,337,703 | B2 | | 3/2008 | Sansolo | |
| 7,536,956 | B2 | | 5/2009 | Sammons et al. | |
| 7,819,063 | B1 | | 10/2010 | Lehman | |
| 8,006,621 | B1 | * | 8/2011 | Cherry | 102/476 |
| 8,307,749 | B2 | * | 11/2012 | Reed | 89/36.17 |
| 2004/0200342 | A1 | | 10/2004 | Sansolo | |
| 2005/0126420 | A1 | | 6/2005 | Givens et al. | |
| 2006/0201373 | A1 | | 9/2006 | Sammons et al. | |
| 2009/0133597 | A1 | | 5/2009 | Moore | |
| 2009/0301334 | A1 | | 12/2009 | Murray et al. | |

* cited by examiner

*Primary Examiner* — Daniel J Troy
(74) *Attorney, Agent, or Firm* — Deborah A. Peacock; Philip D. Askenazy; Peacock Myers, P.C.

(57) ABSTRACT

The present invention provides a method for explosively destroying munitions in an overpacked container within a sealed detonation chamber, utilizing a plurality of specially shaped linear-shaped charges and/or a combination of special linear-shaped charges in conjunction with an explosively formed projectile, resulting in penetrating both the side wall of the overpacked container and the side wall of the projectile.

24 Claims, 16 Drawing Sheets

EXPLOSIVE SYSTEM FOR DESTRUCTION OF OVERPACKED MUNITIONS

CROSS-REFERENCE TO RELATED APPLICATIONS

This application claims priority to U.S. Provisional Patent Application Ser. No. 61/156,289 titled "Explosive System For Destruction of Overpacked Munitions," filed on Feb. 27, 2009, and the specification of that application is incorporated herein by reference.

BACKGROUND OF THE INVENTION

1. Field of Invention

The present invention relates to systems, methods and apparatuses for explosively breaching and destroying munitions, for example conventional munitions that are normally encountered in military EOD field clearing operations or chemical munitions, which are contained in an overpacked shipping or storage container that is preferably housed in a sealed detonation chamber.

2. Description of Related Art

Note that the following discussion refers to a number of publications by author(s) and year of publication, and that due to recent publication dates certain publications are not to be considered as prior art vis-à-vis the present invention. Discussion of such publications herein is given for more complete background and is not to be construed as an admission that such publications are prior art for patentability determination purposes.

Various techniques currently use explosives to rupture military ordnance. Most techniques use a counter charge consisting of a block of demolition explosive placed in direct contact with the piece of live ordnance. Other techniques employ shaped charges that are placed directly on top of the munition, thus penetrating the munition and igniting or detonating the high explosive filler contained within the ordnance. Though these techniques have proven to be very effective, they are ineffective in destroying a munition such as a chemical munition that is housed in a steel overpacked shipping container and is to be de-milled in a total containment detonation chamber. Overpacked munitions are typically leaking or damaged munitions, which are typically placed in metal tubes with special seals to prevent further leakage.

When destroying ordnance with a demolition block of explosive that is in direct contact with the munition, the charge detonates and delivers a high intensity (approximately 150-300 kilo bars) shock pulse inside the munition. This high intensity shock pulse travels through the wall of the ordnance shell and into the shell's high explosive filler. The intensity of the direct shock coupling diminishes as it travels through the wall of the projectile and into the explosive. Depending upon both the intensity and duration of the shock pulse, and the sensitivity of the explosive filler, the projectile's explosive filler can be ignited, deflagrated, or detonated.

Techniques using shaped charges usually deploy a copper lined conical shaped charge that produces a hypervelocity copper projectile that penetrates the munition and either deflagrates or detonates the munition's explosive filler. Other techniques employ the use of wedge-shaped metal lined linear shaped charges that cut into the munition's casing and ignite or deflagrate the explosive filler.

While both of these described techniques are effective for destroying bare conventional munitions in an open environment, these techniques are an ineffective means of safely destroying, for example, a chemical-filled projectile contained within a shipping/storage overpacked container which is being de-milled/destroyed within a total containment detonation chamber.

The overpacked container or housing presents a problem that renders the above techniques useless in a controlled and completely contained environment. The desired effect is to breach the munition and destroy the chemical filler without causing harm to the sealed containment chamber. Due to the standoff distance (distance between munition/projectile's surface and position of the counter charge) created by the wall of the overpacked container, contact charges cannot effectively deliver or communicate their energy to the projectile's surface, and thus the shock intensity from the contact counter charge is greatly reduced. The intensity diminishes approximately as the inverse square to the inverse cube of the distance from the charge's surface. Thus the barrier created by the overpacked container typically renders the contact charge technique useless to breach projectiles contained in an overpacked container.

The distance provided by the overpacked wall also creates a problem of using conventional wedge shaped linear-shaped charges to breach thick-walled chemical-filled projectiles. A commercial linear-shaped charge has a void typically shaped into a chevron or inverted "V" along its entire length, thus employing a wedged-shaped or chevron-shaped geometry. A linear-shaped charge is designed to cut linearly through its target. Standard linear-shaped charge liner angles range from 80-100 degrees.

FIG. 1 is an illustration of a standard linear-shaped charge comprising high density high explosive filler 2 enveloped in metal housing 3 with chevron-shaped or wedge-shaped metal liner 4 at the base of the charge. The charge is typically initiated at one end, and the detonation traverses down the axis of the charge at the velocity of the detonating explosive.

Upon detonation, explosive filler 2 exerts extreme pressures into metal housing 3 and metal liner 4. The pressures begin to accelerate the liner material 4 from each side towards the axis of the charge.

The pressures induced into the liner segments are so large (greater than 200 kilobars) that the strength of the liner may be neglected and the liner material may be treated as a non-viscous fluid that behaves hydrodynamically. In other words, upon detonation, the explosive generates high intensity shocks that induce high pressures into the liner wall of the shaped charge. The pressure generated is far beyond the elastic-plastic limit of the metal, thus accelerating the metal liner in a fluid-like manner onto the axis of the charge. These charges collapse the wedge or chevron shaped liner producing a high velocity fluid-like stretching metallic jet. Due to the impact pressure of the metallic jet on a target surface, both the jet/target interfaces behave hydrodynamically.

The jets are capable of penetrating steel and other hardened targets. The penetration capability of a metallic jet formed by a shaped charge is a function of the effective jet length. To a first approximation, penetration into hardened targets, such as steel, is proportional to the length of a coherent jet whose velocity along its entire length (jet tip to tail) is sufficient to cause plastic flow of the target during impact.

As the two sides of the liner material collapse symmetrically and impinge upon each other, the metal begins to flow inward and collide at anterior collision point A. This collision point A is aligned with the bisector of the interior angle of the liner adjacent to the charge axis. Under these extreme pressures, the metal liner flows from the collision point in two opposite directions along the axis of the charge. Simultaneously, the liner material flowing toward the apex of the charge forms slug 5 while the liner material flowing away from the charge apex forms jet 6.

Though traveling in opposite directions, both the slug 5 and the jet 6 have equal velocities within the flowing liner mass. Since the liner mass is accelerated away from the expanding explosive products, the entire liner mass (both jet and slug) has a net forward velocity in the direction of the jet. Segments of the liner mass are accelerated by the adjacent explosive mass. Changes in the quantity of adjacent explosive mass cause the liner mass segments to accelerate at varying rates. These changes in acceleration yield varied pressures of impact as segments of the liner mass impinge upon each other at collision point A. This variance in impact pressures creates a blade-shaped projectile that exhibits a substantial velocity gradient along its length. The projectile velocity decreases monotonically from jet tip 7 to tail 8. The liner material near the liner's apex region is adjacent to the greatest quantity of explosives. This produces the highest velocity during impingement which forms the front forward end of the jet or jet tip 7.

Typical linear wedge-shaped geometries produce jets with tip speeds ranging from 10,000 ft./sec. to 15,000 ft./sec. while the rear of the jet travels at approximately 3,000 ft/sec. Due to this large velocity gradient, the jet stretches very quickly with distance; i.e. the jet stretches as the standoff distances increases. With wedge or chevron type linear-shaped charges, the jet has stretched to its maximum length after traveling approximately two charge diameters. Within this short distance the jet begins to stretch and then breaks apart. At this point, the jet begins to break apart into pieces 9 resulting in a decrease in penetration or cutting capability.

Therefore, common 90° angle linear-shaped charges producing jets with high velocity gradients dissipate quickly over long standoff distances making them unsuitable for penetrating steel-type or hardened targets at long standoff distances. Thus the conventional linear-shaped charge is an ineffective tool to cut/penetrate steel-type targets at long standoff distances.

The present invention comprises a method of deploying shaped charges that are effective at penetrating targets at long standoff distances.

BRIEF SUMMARY OF THE INVENTION

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

The present invention preferably comprises a method of disabling a munition, wherein the munition comprises a chemical munition, contained in an overpacked container, the method preferably comprising using one or more linear shaped charges. The container preferably comprises a single overpacked container. The container alternately comprises or a double overpacked container. The method further comprises penetrating metallic barriers with the charges.

Another embodiment of the present invention preferably comprises a method wherein at least one of the shaped charges comprises a specially designed shaped charge. The method further comprises simultaneously penetrating a base plate and a side wall of the munition.

At least one of the charges of the present invention preferably comprises a hemi-cylindrical shaped charge and alternately comprises a wide-angle shaped charge.

The container and munition preferably comprise a standoff distance of greater than two charge diameters, and more preferably comprise a standoff distance greater than four charge diameters.

The method of the present invention comprising disabling a munition, preferably comprises using a plurality of linear shaped charges to sever the munition into two or more longitudinal pieces. The method further comprises penetrating the munition with a plurality of linear projectiles. The charges preferably comprise hemicylindrical and/or wide angle shaped charges.

An embodiment of the present invention preferably comprises a method of disabling a munition, the method comprising using a linear shaped charge which increases in size along a linear axis of the charge, wherein the charge accommodates penetrating a thicker side wall and/or projectile base of the munition. The munition preferably comprises a chemical munition.

An embodiment of the present invention preferably comprises a method of penetrating one or more layers of a metallic barrier, the method comprising the steps of: detonating a charge; and explosively forming a linear projectiles, the projectile extending a distance between the charge and the barrier of greater than two charge diameters, where the projectiles comprise non-stretching projectiles.

The present invention also preferably comprises an apparatus for disabling a munition contained in a container, the apparatus comprising: a shaped charge; an inverting liner disposed adjacent to said shaped charge; and a frangible container housing said charge and said liner, wherein the liner preferably comprises a hemi-cylindrical or wide angle shaped liner. The liner preferably comprises a metal. The housing preferably comprises a polymer. The liner preferably inverts and jettisons from the charge upon detonation. The liner preferably remains integral after being jettisoned.

Another embodiment of the present invention comprises an apparatus comprising a charge wherein the charge increases in size along a linear axis of the charge and wherein the container is an overpacked container and wherein the munition comprises a chemical munition.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
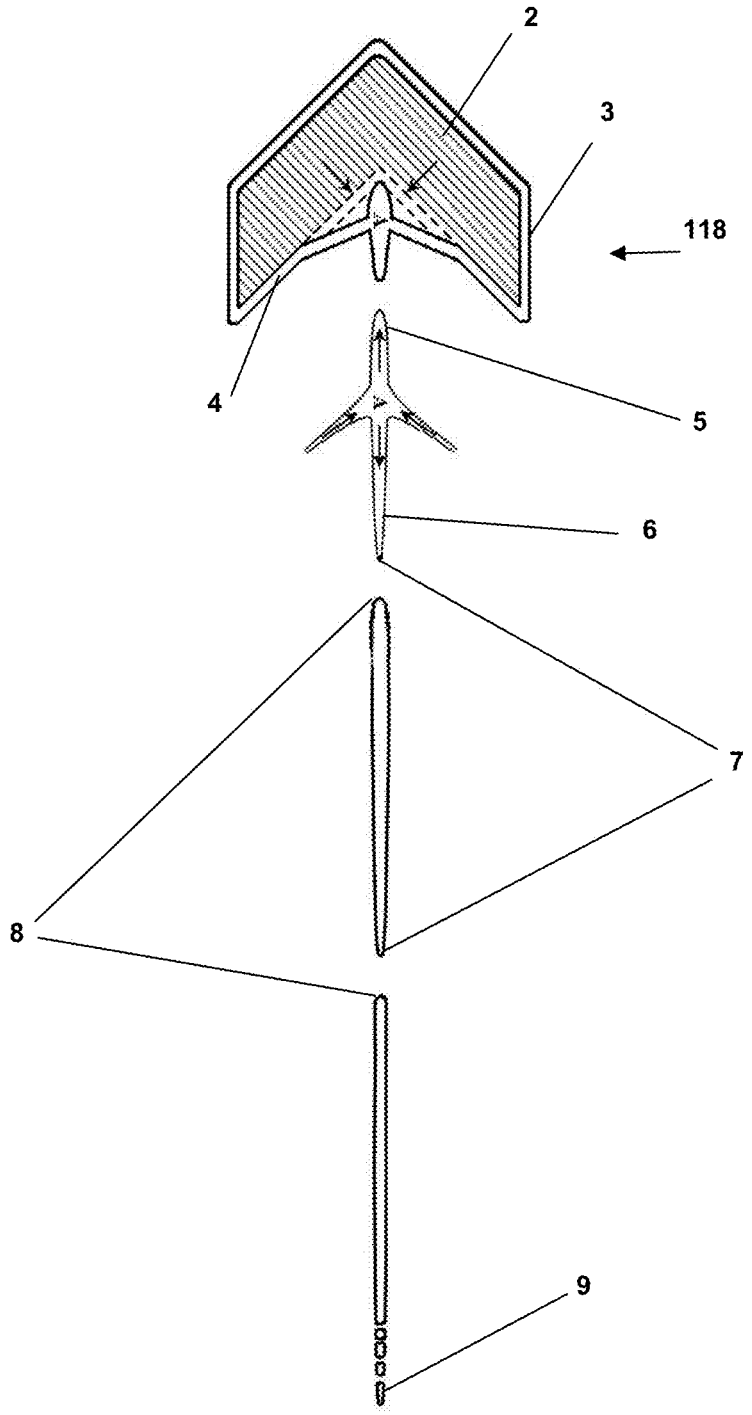
FIG. 1 is an end view illustrating four phases of jet formation resulting from a commercial wedge-shaped or chevron shaped linear-shaped charge, at successive times.

An embodiment of the present invention preferably provides a method and apparatus for explosively destroying munitions in an overpacked container within a sealed detonation chamber. An embodiment of the present invention preferably utilizes a plurality of specially shaped linear-shaped charges and/or a combination of special linear-shaped charges in conjunction with an explosively formed projectile. The special shaped linear-shaped charges are preferably capable of penetrating both the side wall of the overpacked container and the side wall of the projectile. The explosive formed projectile (EFP) is capable of penetrating both the thick (typically approximately ¾") steel endplate of the overpacked container and the thick base of the explosive or chemical filled projectile.

The specially shaped linear-shaped charges preferably do not utilize typical wedge shaped geometry. The high explosive charges preferably employ a hemi-cylindrical or wide angle shaped metallic or non-metallic liner that is affixed to a high explosive charge. The explosive charge and liner are preferably housed in a soft frangible container that is constructed from plastic or low density rigid polyurethane type foam. By employing a hemi-cylindrical shaped liner or wide angle (approximately 100-120 degree) liner, the jets or projectile produced preferably comprise a small velocity gradient within the jet/projectile. This unique feature preferably retards jet breakup and produces a stable jet/projectile capable of penetrating layered steel targets at long standoff distances. Charge geometries of this design type can penetrate steel targets at standoff distances of greater than approximately four, five, or six charge diameters up to approximately fifteen charge diameters or even greater, and more preferably standoff distances from approximately four to eight charge diameters. The high explosive filler preferably creates high detonation pressures and has a good ability to propel metals. Explosive fillers may comprise, for example, composition C-4, composition B, pentolite, octol, cyclotol, or a plastic bonded explosive (PBX) such as LX-14. Upon detonation the soft housing preferably disintegrates into small low density pieces thus preventing fragmentation damage to the containment vessel wall.

The explosively formed projectile (EFP) is preferably formed from a shallow disc, shallow cone, or a solid hemisphere and may comprise, for example, metals, plastics, gels, or ceramics. The shallow disc, shallow cone, or hemisphere may comprise, for example, magnesium, magnesium alloy, aluminum, aluminum alloy, stainless steel, iron, copper, acrylic, polycarbonate, or ceramics. Typical EFPs comprise pure deaf soft OFHC copper, iron, or annealed steel. The disc or hemisphere is preferably affixed to a high velocity, high density explosive charge as listed above. The projectile and explosive are preferably housed in a soft plastic or foam container. The solid hemisphere projectile for EOD applications is described in commonly owned U.S. patent application Ser. No. 12/210,998, entitled "Explosive Breaching Apparatus and Method Using Lensing".

The multiple hemicylindrical or wide angle shaped charges are preferably simultaneously initiated at the fuzed end of the projectile. Jets formed from the charges preferably penetrate the overpacked container and traverse through any media between the overpacked housing and into the projectile's steel casing. The jets may weaken or completely rupture the casing of the projectile. The explosively formed projectile (EFP) is preferably initiated sequentially with the other charges. The EFP is preferably time sequenced to penetrate the end plate of the overpacked container and continue through the base of the projectile at or near the same instance that the linear explosive charge jets penetrate the walls adjacent to the projectile base. The combination of multiple hemicylindrical or wide angle shaped charges jets penetrating or weakening the projectile's casing in conjunction with the hole of the projectiles base from the penetration of the EFP preferably causes the chemical munition to peel open and rupture completely. The pressure induced into the chemical filled projectile from the jets and the EFP also preferably causes an internal hydraulic effect which aids in rupturing the projectile.

Timing of the charges' initiation sequence may be accomplished by, but is not limited to, the use of a manifold of detonating cord with secondary explosive boosters affixed to the ends of the detonating cord. The detonating cord manifold preferably ascertains sequential arrival timing of explosively generated jets/projectiles within a few tens of microseconds.

An alternative embodiment of the invention utilizes hemicylindrical shaped or wide angle linear-shaped charges that have an increased width, size, and or explosive load towards the base end of the projectile. The larger diameter charges or charges having a larger explosive content located near the base of the munition or projectile amplifies the cuts, increasing penetration at the base plate of the projectile thus causing complete fracturing of the projectile's case.

Figure 2A:
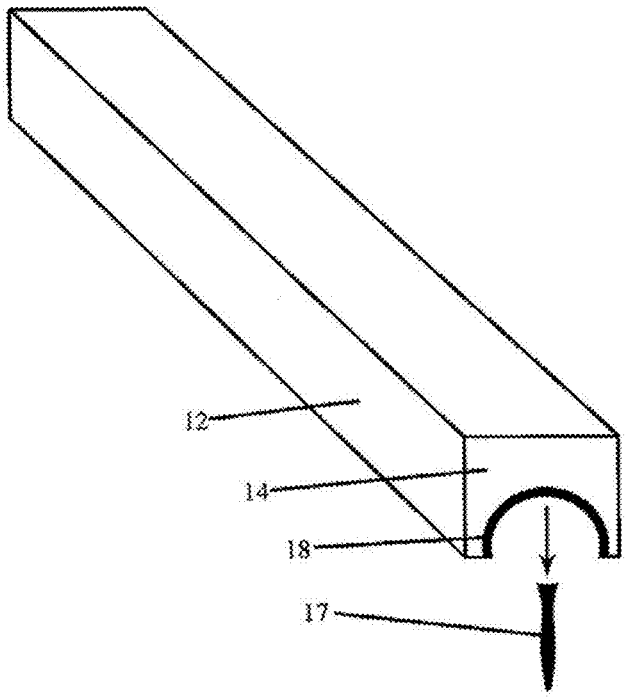
FIG. 2A is an illustration of a hemicylindrical shaped charge with a frangible housing.

The drawings represent various embodiments of the invention. Referring to FIG. 2A, a first embodiment of the invention is illustrated comprising frangible housing 12 that envelopes high explosive charge 14 which is affixed to copper hemicylindrical liner 18. Upon detonation, the hemicylindrical shaped charge produces high velocity non-stretching jet 17. Upon detonation of explosive filler 14, high pressures impinge upon the liner 18 inverting it in a fluid-like fashion creating a high velocity non-stretching jet 17.

Figure 2B:
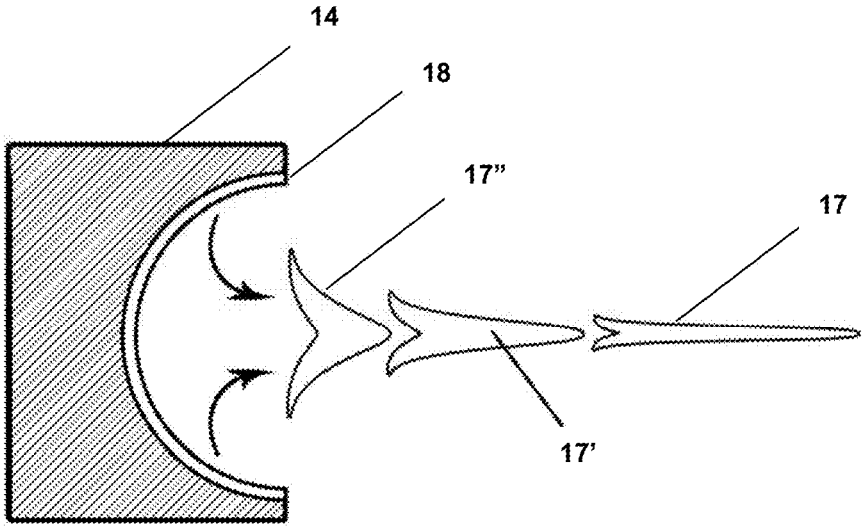
FIG. 2B is an illustration of an end view showing jet formation from a hemicylindrical shaped charge at three successive times.

Referring to FIG. 2B, jet formation from the hemicylindrical shaped charge of FIG. 2A at three successive times is illustrated. Initial jet shape 17" transforms to shape 17' and finally results in shape 17, which does not break up, unlike the jet resulting from conventional wedge-shaped charges. Thus, thick steel casings can easily be penetrated at long standoff distances with the present invention.

Figure 2C:
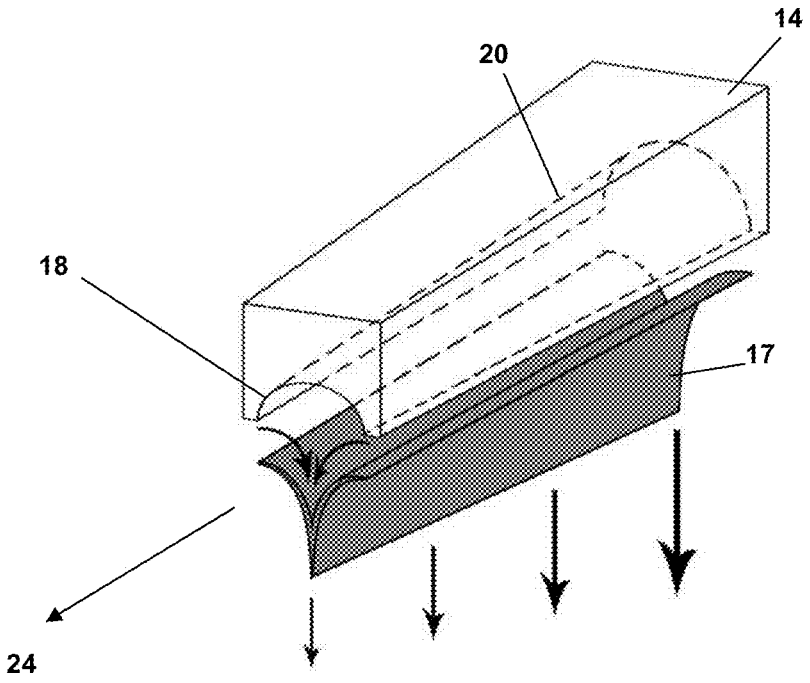
FIG. 2C is side perspective view of a hemicylindrical shaped charge comprising a gradual increase in housing size, explosives, and liner mass quantity down the charge's linear axis.
Figure 9:
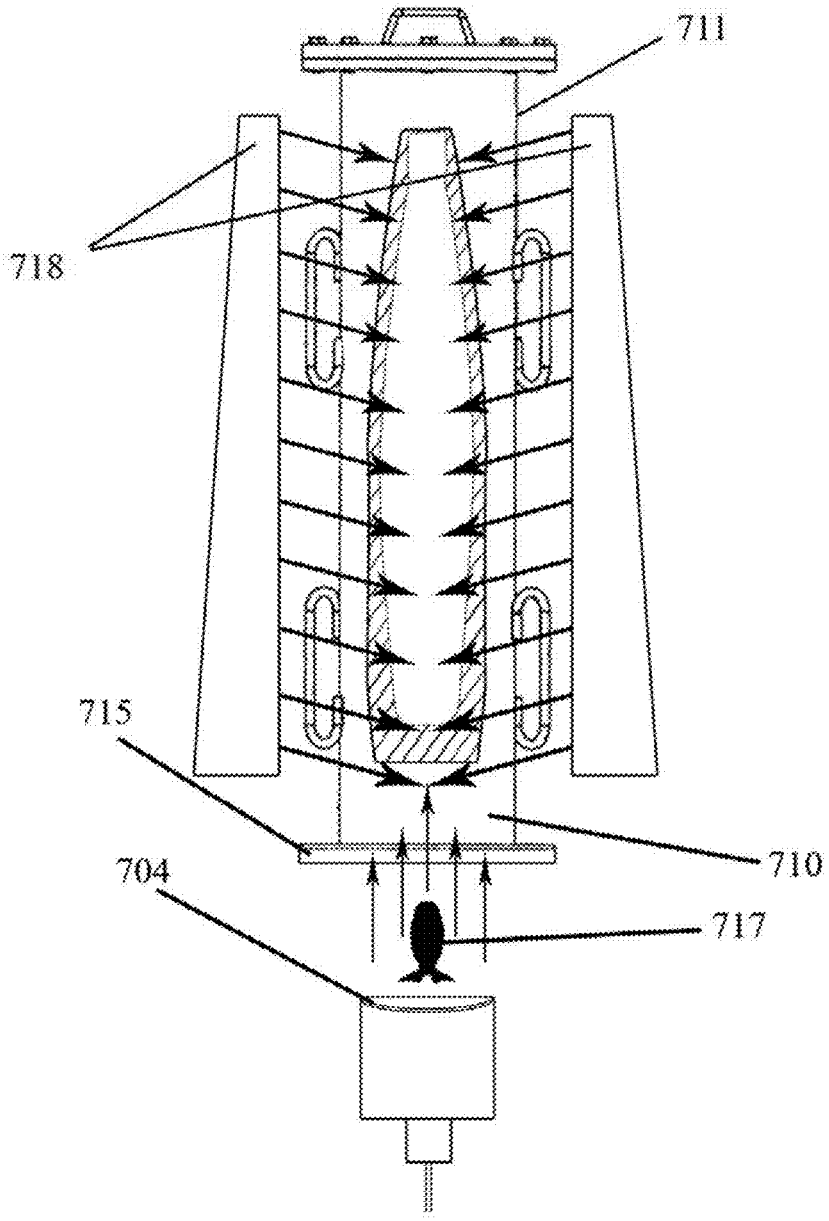
FIG. 9 is an illustration of a side view of an overpacked container housing a chemical munition with explosive charges simultaneously attacking an overpacked container and a chemical munitions projectile.

Referring to FIG. 2C, another embodiment of the present invention comprises a hemi-cylindrical shaped charge comprising linear contour 20 and a gradually increasing housing size resulting in an increasing quantity of explosives filler 14, and an increasing liner 18 mass quantity, with the increases perpendicular to charge linear axis 24. The increase in explosive mass 14, and liner mass 18 at one end of the shaped charge results in greater penetrating force of the projectile jet 17 at that end. Penetration of linear shaped charges into hard targets such as steel is directly scalable to the size of the charge providing that the two different size charges are of the same geometry and each charge component (liner thickness, explosive mass, and housing confinement—if any) is scaled proportionally and has the same manufacturing tolerances. A 50% increase in both the linear shaped charge's width and height results in a 225% increase in explosive filler per unit length. This increase in charge size relates to a 50% increase in penetration. The increasing end of the hemi-cylindrical shaped charge is placed adjacent to the thicker base end of the chemical projectile as illustrated in FIG. 9.

Figure 3A:
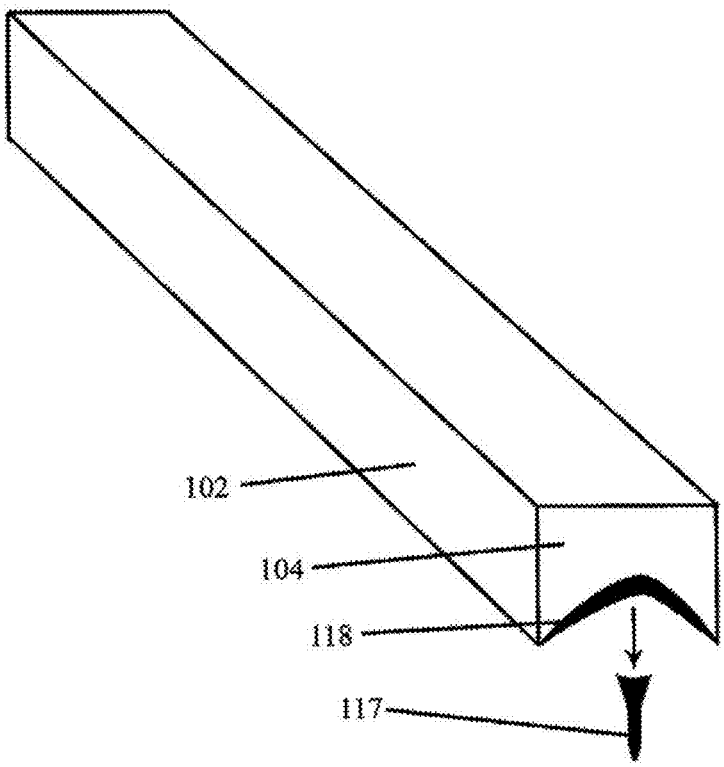
FIG. 3A is an illustration of a wide-angle linear shaped charge with a frangible housing.

Referring to FIG. 3A, a second embodiment of the invention is illustrated comprising frangible housing 102 that envelopes high explosive charge 104 which is affixed to wide-angle metallic liner 118. Upon detonation, the wide-angle linear-shaped charge produces a high velocity non-stretching projectile 117. Upon detonation of explosive filler 104, high pressures impinge upon liner 118 inverting it in a fluid-like fashion creating high velocity non-stretching projectile 117.

Figure 3B:
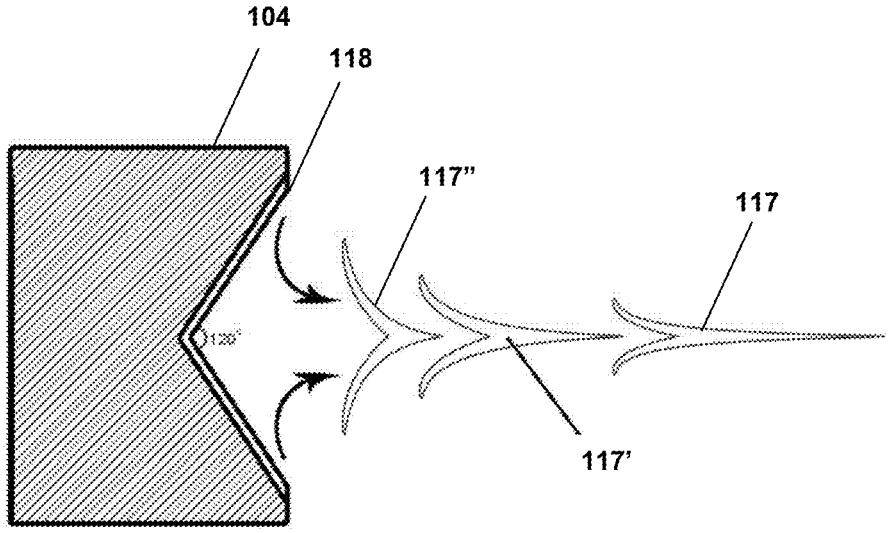
FIG. 3B is an end view illustrating jet formation from a wide-angle linear-shaped charge at three successive times.

FIG. 3B illustrates high explosive charge 104 which is affixed to 120° wide angle metallic liner 118. Initial jet shape 117" transforms to shape 117' and finally results in shape 117, which does not break up, unlike the jet resulting from conventional wedge-shaped charges. Thus, thick steel casings at long standoff distances can easily be penetrated with the present invention.

Wide angle (greater than 120°) linear-shaped charges (FIG. 3B) and hemi-cylindrical shaped charges (FIG. 2B) do not form projectile jets through liner collision in the same fashion as typical 90° angle shaped charges. Upon detonation, wide angle linear-shaped charges and hemi-cylindrical liners are inverted to form a projectile jet. The term "inverting" means the use of any inverse shaped charge, including but not limited to hemi-cylindrical, wide angle, wedge, parabolic, and arc, in which the liner inverts or turns inside out and jettisons from the shaped charge.

The wide angle and hemi-cylindrical liners turn inside out after detonation of the charges and remain integral for a longer time even when stretched, unlike conventional shaped charges. The resultant jet from the inverted liner has a smaller velocity gradient within the jet when compared to projectile jets formed by typical 90 degree angle shaped charges. These inverted jets 17, 117 stretch apart slower in time in comparison to the stretching jets of common 90° angle linear-shaped charge systems.

The delayed stretching of inverted jets 17, 117 formed by wide angle and hemicylindrical shaped charges allows the resultant projectiles to remain intact for longer periods of time and traverse greater distances than projectiles formed by common 90° angle linear shaped charge systems. Because these jets remain intact, wide angle and hemicylindrical shaped charges are preferable when attempting to penetrate targets at long stand-off distances or with multiple barriers.

Figure 4:
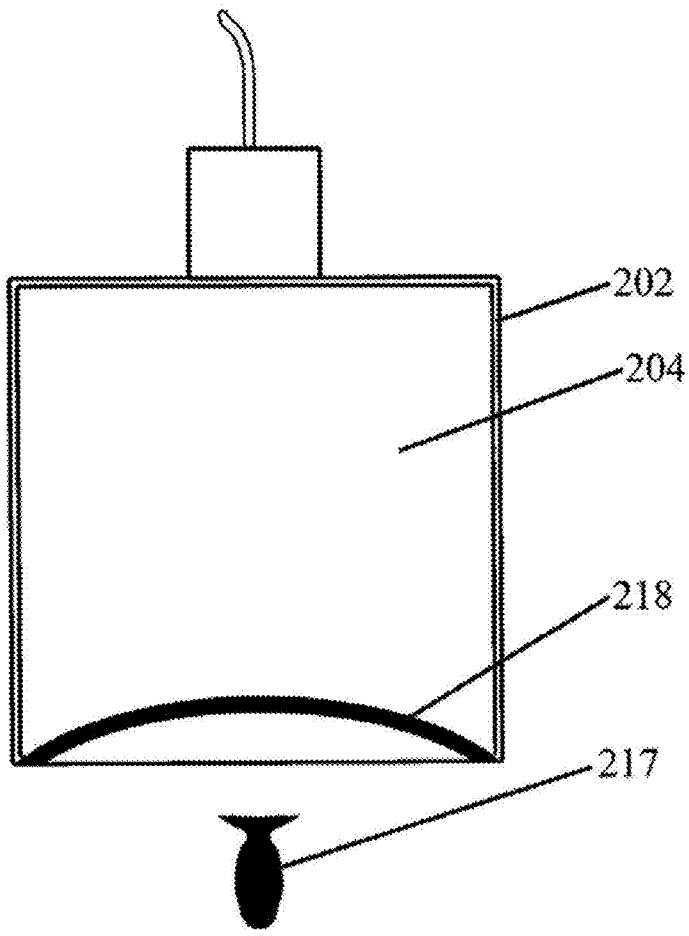
FIG. 4 is an illustration of a shallow disc explosively formed projectile charge with a frangible housing.

Referring to FIG. 4, a third embodiment of the invention is illustrated comprising frangible housing 202 that envelopes high explosive charge 204 which is affixed to shallow disc projectile 218. Upon detonation, the shallow disc projectile charge produces high velocity non-stretching projectile 217. Upon detonation of explosive filler 204, high pressures impinge upon disc 218 inverting it in a fluid-like fashion creating high velocity non-stretching projectile 217.

Figure 5:
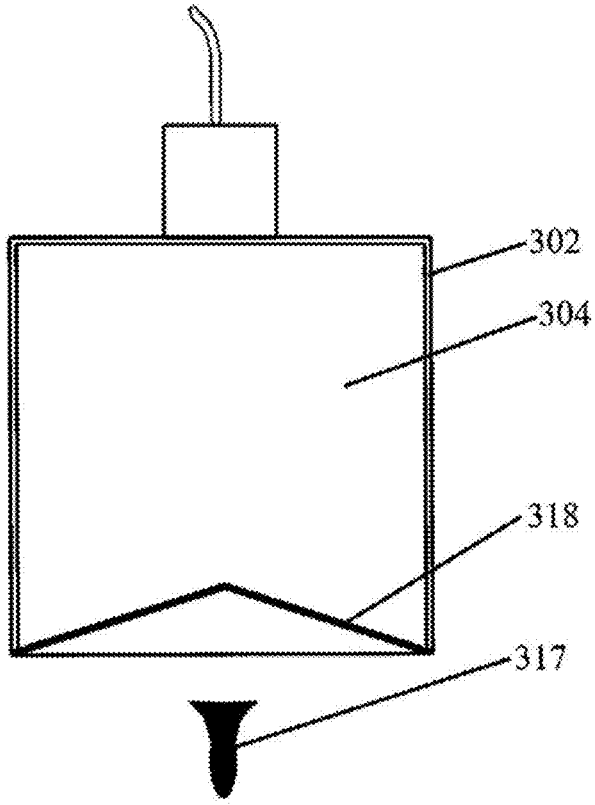
FIG. 5 is an illustration of a shallow cone explosively formed projectile charge with a frangible housing.

Referring to FIG. 5, a fourth embodiment of the invention is illustrated including frangible housing 302 that envelopes high explosive charge 304 which is affixed to shallow cone projectile 318. Upon detonation, the shallow cone projectile charge produces high velocity non-stretching projectile 317. Upon detonation of explosive filler 304, high pressures impinge upon cone 318 inverting it in a fluid-like fashion creating high velocity non-stretching projectile 317.

Figure 6:
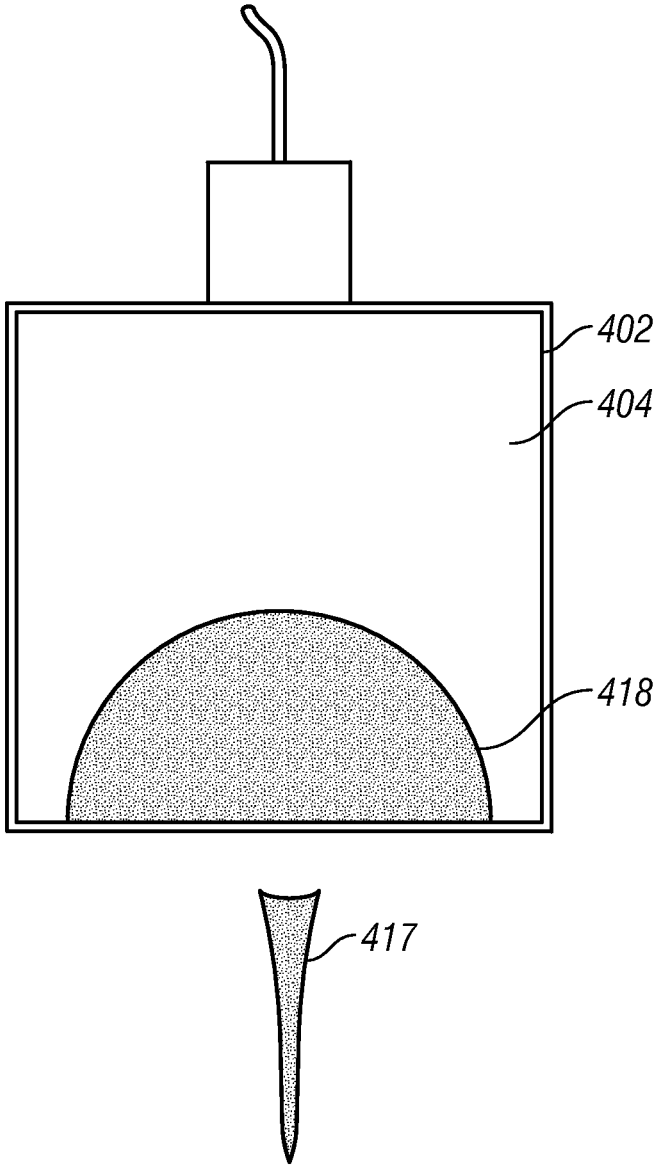
FIG. 6 is an illustration of a hemispherical shaped explosively formed projectile charge with a frangible housing.

Referring to FIG. 6, a fifth embodiment of the invention is illustrated including frangible housing 402 that envelopes high explosive charge 404 which is affixed to a solid hemisphere shaped projectile 418. Upon detonation, the hemisphere projectile charge produces high velocity non-stretching projectile 417. Upon detonation of explosive filler 404, high pressures impinge upon hemisphere 418 inverting it in a fluid-like fashion creating high velocity non-stretching projectile 417.

Figure 7:
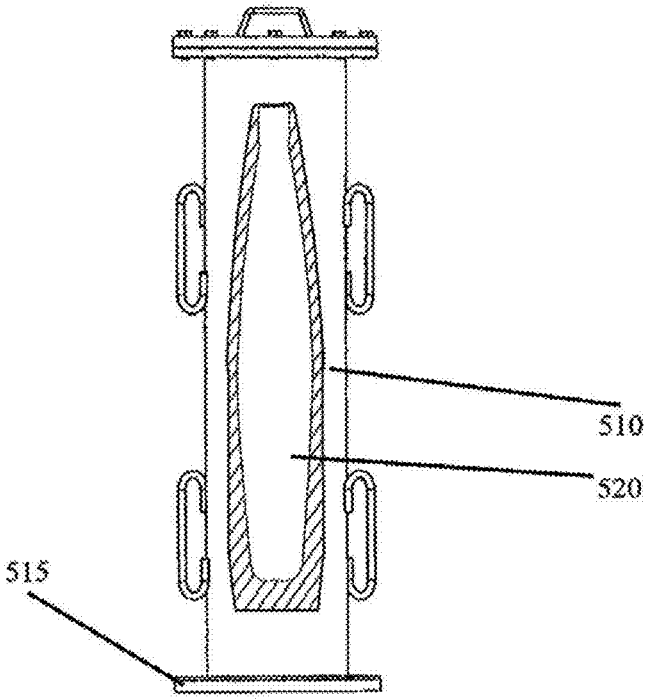
FIG. 7 is an illustration of an overpacked container housing a chemical munition.

FIG. 7 shows an illustration of an overpacked container 510 containing a chemical munition 520. The overpacked container has heavy reinforced steel flanges 515.

Figure 8:
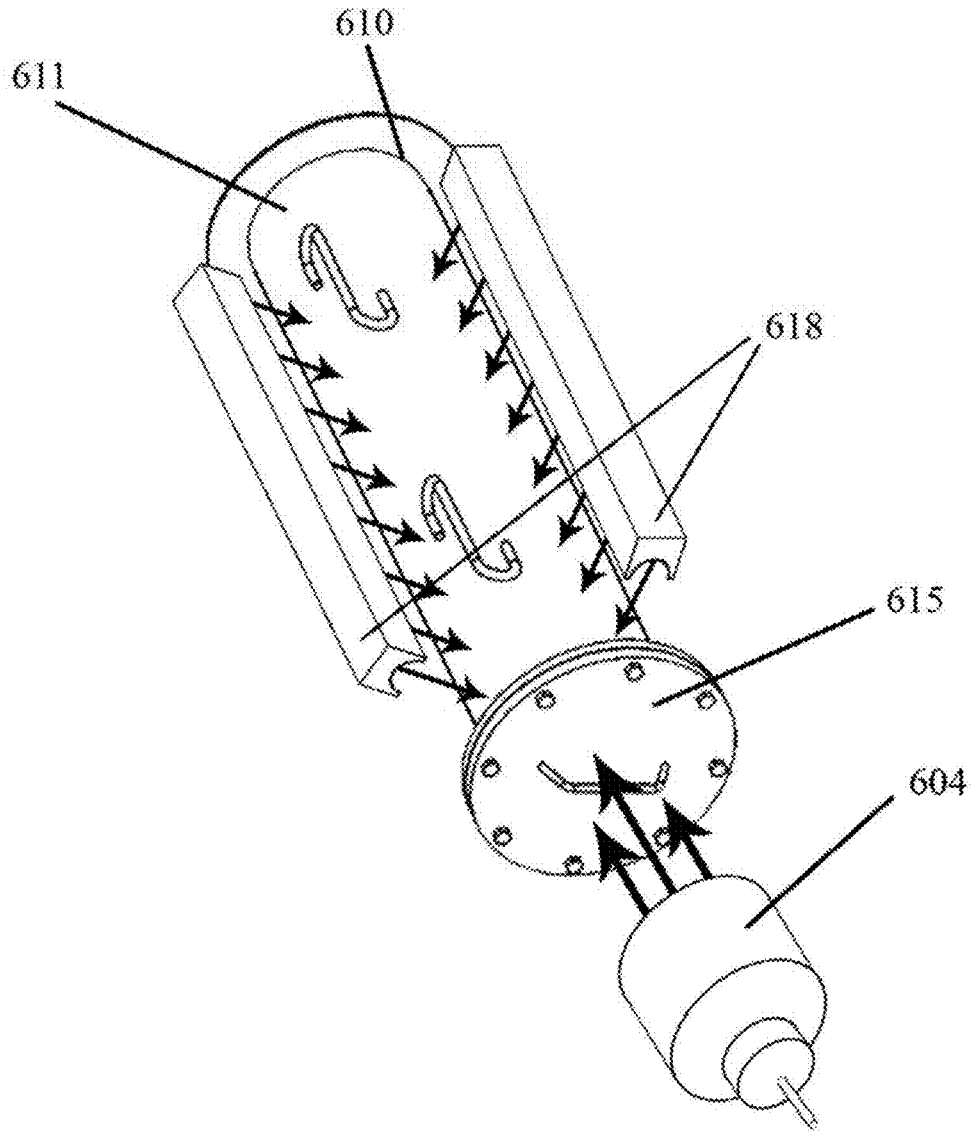
FIG. 8 is an illustration of an overpacked container housing a chemical munition with explosive charges attacking the side and end of the overpacked container.

FIG. 8 shows an illustration of an overpacked container 610 with hemicylindrical shaped charges 618 and EFP charge 604 positioned to penetrate side walls 611 and end plate 615 of the overpacked container.

FIG. 9 shows an illustration of a side view of an overpacked container 710 with increasing size hemicylindricai shaped charges 718 and EFP charge 704 positioned to penetrate side walls 711 and end plate 715 of the overpacked container 710. FIG. 9 shows explosively formed non-stretching projectile 717 produced from EFP charge 704.

Figure 10:
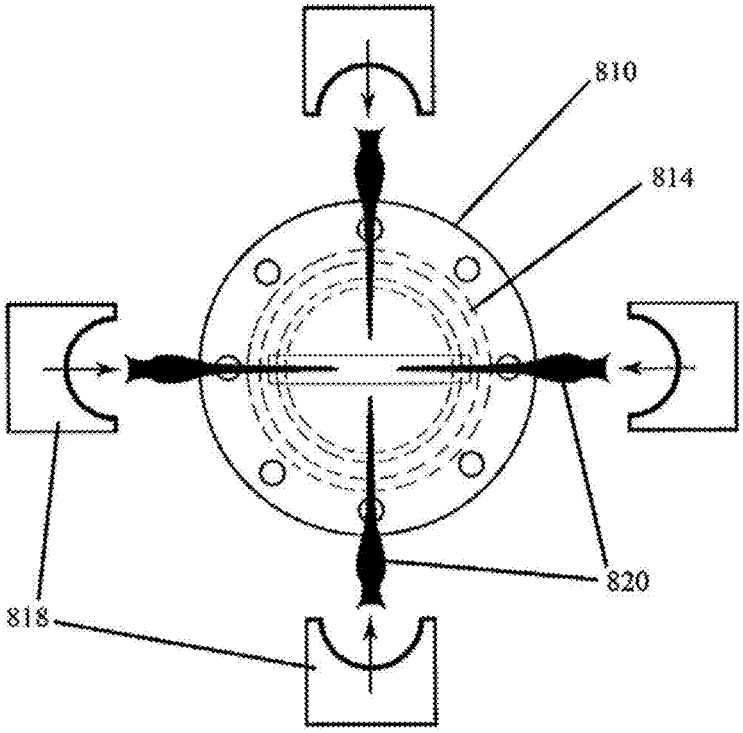
FIG. 10 is an illustration of an end view of an overpacked container housing a chemical munition with explosive charges simultaneously attacking an overpacked container and a chemical munitions projectile.

FIG. 10 shows an illustration of an end view of an overpacked container 810 with hemicylindrical shaped charges 818 positioned to penetrate the side walls of overpacked container 810. FIG. 10 shows explosively formed non-stretching jets 820 produced from hemicylindrical shaped charges 818 penetrating the overpacked container 810 and chemical filled munition 814. Alternately, wide-angle shaped charges may be used.

Figure 11:
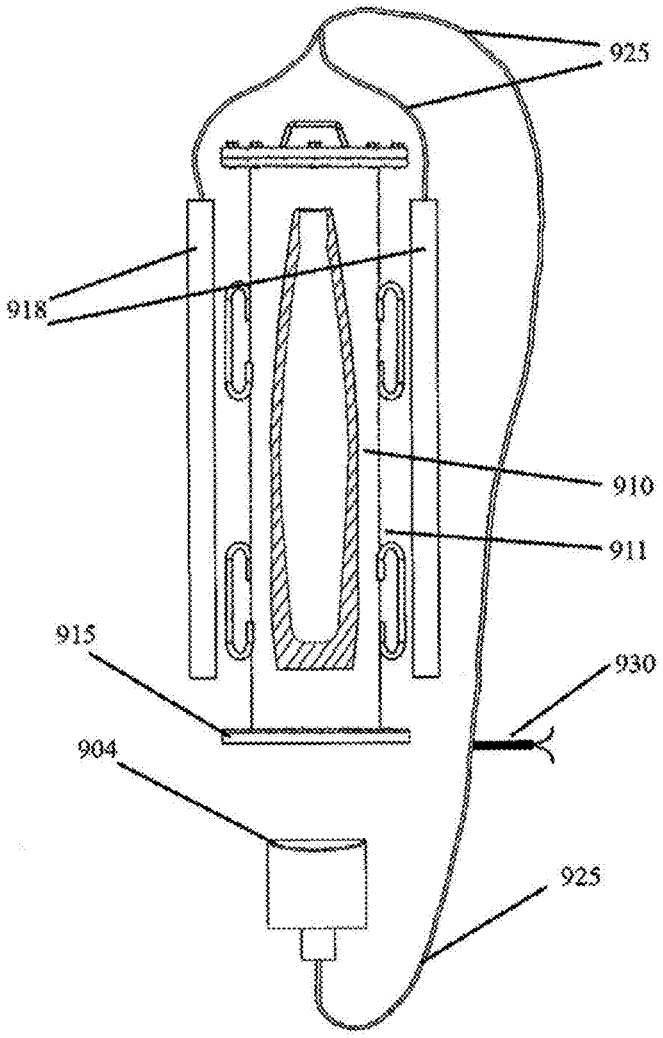
FIG. 11 is an illustration of the initiation system of multiple charges sequentially timed to attack a chemical munition housed in an overpacked container.

FIG. 11 shows an illustration of a side view of an overpacked container 910 with hemicylindrical shaped charges 918 and EFP charge 904 positioned to penetrate side walls 911 and end plate 915 of the overpacked container 910 respectively. FIG. 11 shows detonating cord manifold 925 initiated by precisely positioned single initiator 930 to provide simultaneous initiation of the hemicylindrical shaped charges and sequentially time initiate EPF charge 904.

Figure 12A:
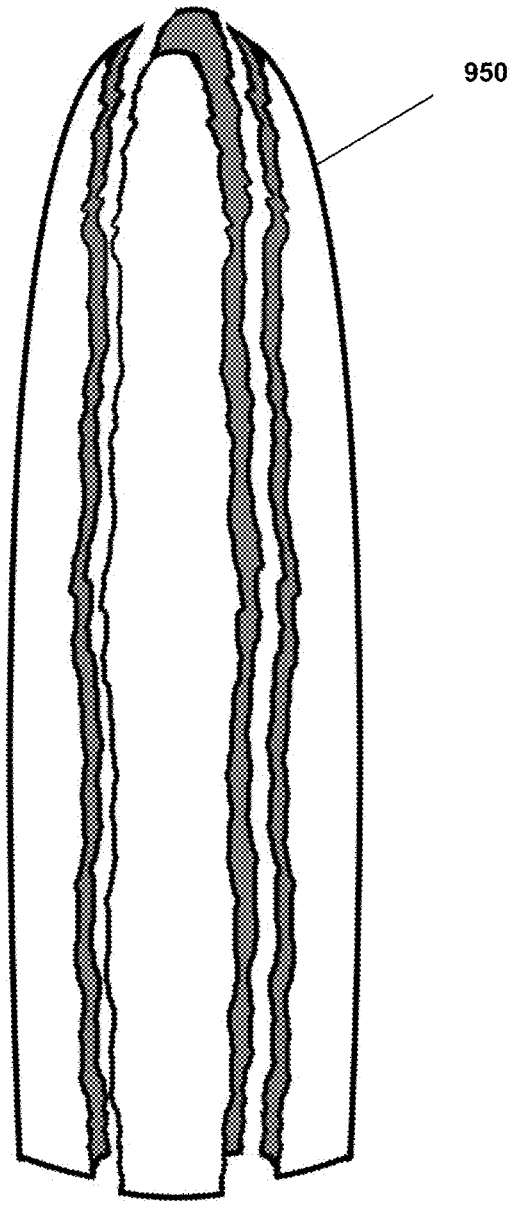
FIG. 12A is an illustration of a side view of longitudinal fragmented pieces of a chemical munition.

FIG. 12A is an illustration of a side view of longitudinal fragmented pieces of chemical munition 950 created by the simultaneous impact of four hemicylindrical shaped charge jets and an explosively formed projectile. Thick-walled artillery shell 950 that may contain chemical agents is cut into two or more pieces by the wide-angle and/or hemicylindrical shaped charges of the present invention.

Figure 12B:
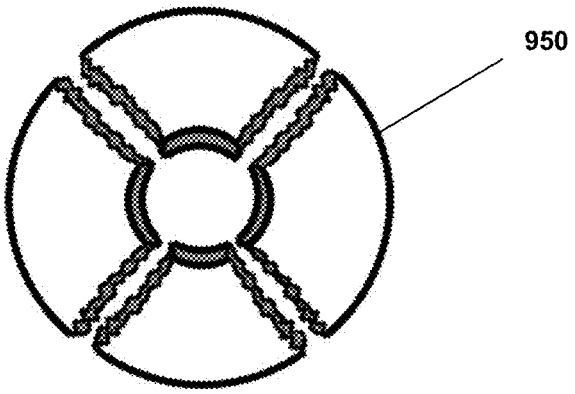
FIG. 12B is an illustration of an end view of longitudinal fragmented pieces of a chemical munition.

FIG. 12B is an illustration of an end view of longitudinal fragmented pieces of chemical munition 950 created by the simultaneous impact of four hemicylindrical shaped charge jets and an explosively formed projectile.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all patents, references, and publications cited above are hereby incorporated by reference.

What is claimed is:

1. A method of disabling a munition contained in a container, the method comprising positioning a plurality of straight linear shaped charges around a circumference of the exterior of a container for receiving and enclosing a munition, the container separate from and not a part of the munition;

wherein each charge comprises a frangible housing enveloping an explosive filler disposed adjacent to an inverting liner; and wherein a length of each charge is disposed along a length of the container and each liner is disposed facing inward against the container.

2. The method of claim 1 wherein the container comprises a single overpacked container or a double overpacked container.

3. The method of claim 1 wherein the munition comprises a chemical munition.

4. The method of claim 1 further comprising penetrating metallic barriers with the charges.

5. The method of claim 4 further comprising simultaneously penetrating a base plate and a side wall of the munition.

6. The method of claim 1 wherein at least one of the charges comprises a hemicylindrical shaped charge.

7. The method of claim 6 wherein the container and munition comprise a standoff distance of greater than two charge diameters.

8. The method of claim 7 wherein the standoff distance is greater than four charge diameters.

9. The method of claim 6 further comprising:

detonating the charges;

thereby explosively forming linear projectiles extending a distance between the charge and the barrier of greater than two charge diameters; and penetrating one or more metallic layers of the container and the munition.

10. The method of claim 9 wherein the projectiles comprise non-stretching projectiles.

11. The method of claim 1 wherein at least one of the charges comprises a wide-angle shaped charge.

12. The method of claim 1 comprising severing the munition into two or more longitudinal pieces.

13. The method of claim 12 further comprising penetrating the munition with a plurality of linear projectiles.

14. The method of claim 1 wherein at least one charge increases in size along its linear axis.

15. The method of claim 14 wherein the charge accommodates penetrating a thicker side wall and/or projectile base of the munition.

16. A system for disabling a munition contained in a container, the system comprising:

a plurality of straight linear shaped charges, each charge comprising a frangible housing enveloping an explosive filler disposed adjacent to an inverting liner; and a container for receiving and enclosing a munition, said container separate from and not a part of the munition;

wherein said plurality of straight linear shaped charges are positioned around a circumference of the exterior of said container so that a length of each charge is disposed along a length of said container and each said liner is disposed facing inward against said container.

17. The system of claim 16 wherein at least one said liner comprises a hemi-cylindrical or wide angle shaped liner.

18. The system of claim 16 wherein at least one said liner comprises a metal.

19. The system of claim 16 wherein at least one said frangible housing comprises a polymer.

20. The system of claim 16 wherein at least one said liner inverts and jettisons from the charge upon detonation.

21. The system of claim 20 wherein at least one said liner remains integral after being jettisoned.

22. The apparatus of claim 16 wherein the charge increases in size along a linear axis of the charge.

23. The system of claim 16 wherein the container is an overpacked container.

24. The system of claim 16 wherein the munition comprises a chemical munition.

* * * * *